United States Patent [19]

Coombs

[11] Patent Number: 5,044,016

[45] Date of Patent: Sep. 3, 1991

[54] PROTECTIVE HELMET ASSEMBLY INCLUDING RELEASABLE HEAD RETAINING ASSEMBLY

[75] Inventor: Christopher E. Coombs, Boonton, N.J.

[73] Assignee: Cairns & Brother, Inc., Clifton, N.J.

[21] Appl. No.: 137,378

[22] Filed: Dec. 23, 1987

[51] Int. Cl.[5] ..... A42B 3/02

[52] U.S. Cl. ..... 2/414; 2/5; 2/416; 2/421

[58] Field of Search ..... 2/5, 411, 412, 413, 2/414, 415, 421, 416

[56] References Cited

U.S. PATENT DOCUMENTS

| | | | |
|---|---|---|---|
| 2,969,547 | 1/1961 | Dye | 2/411 |
| 2,971,195 | 2/1961 | Voss | 2/411 |
| 3,350,718 | 11/1967 | Webb | 2/414 |
| 4,286,339 | 9/1981 | Coombs | 2/414 |
| 4,307,471 | 12/1981 | Lovell | 2/411 |

FOREIGN PATENT DOCUMENTS

| | | | |
|---|---|---|---|
| 2700497 | 7/1978 | Fed. Rep. of Germany | 2/411 |
| 1578352 | 11/1980 | United Kingdom | 2/412 |

*Primary Examiner*—Wm. Carter Reynolds
*Attorney, Agent, or Firm*—Louis E. Marn

[57] ABSTRACT

As improved protective helmet assembly including an outer shell and an inner impact attenuation liner assembly wherein a chinstrap assembly is mounted to the inner impact attenuation liner assembly and the inner impact attenuation liner assembly is mounted within the outer impact shell to detach under predetermined load conditions from the outer impact shell.

7 Claims, 2 Drawing Sheets

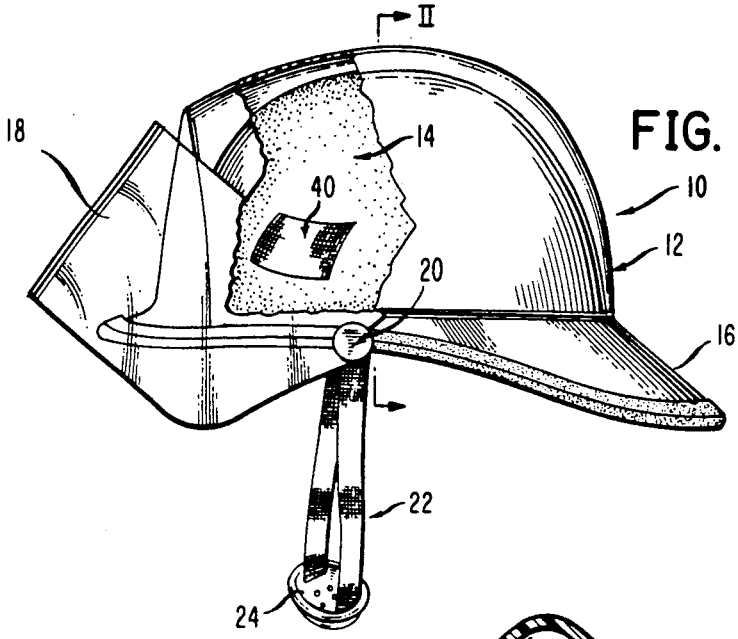
FIG. 1
FIG. 2
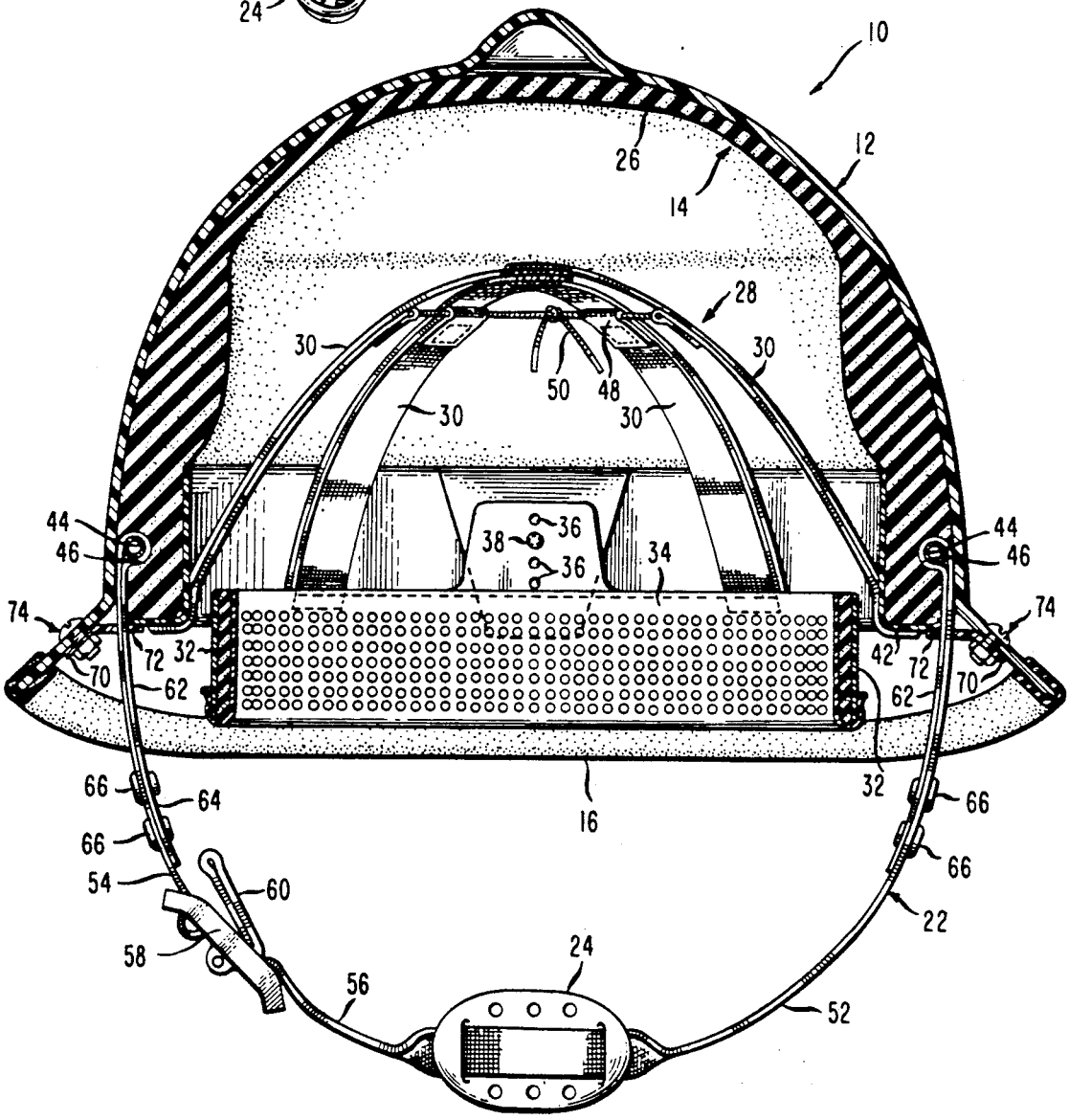

PROTECTIVE HELMET ASSEMBLY INCLUDING RELEASABLE HEAD RETAINING ASSEMBLY

FIELD OF THE INVENTION

This application relates to a safety helmet assembly, such as a fireman's helmet, and more particularly to an improved protective helmet assembly including a releasable head retaining assembly.

BACKGROUND OF THE INVENTION

Protective head gear are manufactured for: competitive sports, such as football; recreational activities, such as climbing; operation of vehicles, such as motorcycles, bicycles, auto racing, etc.; hazardous industrial environments, such as construction, lumbering, and earth moving; the military; aviation; and fire fighting.

Protective headgear for the foregoing activities usually comprises a rigid outer shell of metal or plastic and a suspension system which supports the shell on the wearer's head in a manner which attenuates impact force and distributes the force which is transferred to the head with the purpose of preventing the impacting object from contacting the head and reducing to a tolerable level the acceleration of the head resulting from the impact.

Impact attenuation suspensions principally take the form of a web of straps attached to the shell and arranged as a cradle over the top of the wearer's head, or take the form of a compressible foam liner which occupies most of the space between the wearer's head and the interior of the shell. The familiar "hard hat" of a construction worker is an example of a web suspension whereas motorcycle helmets usually employ foam liners for impact attenuation.

Web suspensions provide better protection than do foam lined helmets for a vertical blow on the top or apex of the helmet. Foam lined helmets provide better attenuation of lateral impacts than do web suspensions. Consequently, activities more likely to occasion lateral impacts than apex impacts are appropriate for the use of foam liner helmets, whereas activities where the hazard is more likely to be falling objects call for web suspensions. For this reason motorcycle helmets are usually foam liner suspension and industrial "hard hats" are web suspension.

Fire service is an exposure to apex impacts and to lateral impacts. Further, fire service entails a high rate of exposure to relatively severe impacts. Falling and toppling objects are common and the fireman's ability to avoid them is hampered by low visibility conditions and equipment burdens. Firemen are also subject to injury of a vehicular nature. Consequently, a fireman's helmet should provide a high degree of attenuation of lateral and of apex impacts. The impact attenuation system of a fireman's helmet, unlike those for lower risk activities, must survive an impact to continue to protect him as the fire continues. A suspension which sacrificially destructs during attenuation is not appropriate for firemen. Severe impacts can cause the sacrificial failure of either web or foam liner suspensions.

In U.S. Pat. No. 4,286,339, there is disclosed a protection helmet, such as fireman's helmet which combines aspects of a web suspension with aspects of a foam liner suspension thereby obtaining the benefits of each form of suspension with the surprising result of apex impact attenuation markedly superior to either web suspensions or foam liner suspensions while providing lateral impact attenuation at least as good as foam liner suspensions. The chinstrap for such helmet assembly is rigidly affixed to the outer shell and is essentially unyielding to retain the protective helmet on the head when most needed, i.e., during a severe impact exposure. Concomitantly, such unyielding configuration resulted in fears of a broken neck or the individual being hung should the wearer fall through a floor or should the brim of the protective helmet place too much leverage on the wearer's neck. While certain prior art protective helmet assemblies are provided with a chinstrap assembly releasably attached to the protective helmet assembly, detachment of the helmet assembly from the user's head left the head of user unprotected against any subsequent contact with an object or against a stationary object.

OBJECT OF THE PRESENT INVENTION

An object of the present invention is to provide a novel protective helmet assembly capable of detaching from the head of a user at a preselected load while retaining an impact protective element.

Another object of the present invention is to provide a novel protective helmet assembly capable of detaching from a head of a user at a preselect range of loads while retaining an impact protective element.

Still another object of the present invention is to provide a novel protective helmet assembly capable of detaching from a head of a user at a preselect load yet providing appropriate retention capabilities at normal user requirements.

Yet another object of the present invention is to provide a protective helmet assembly capable of detaching from a head of a user while providing important protection against subsequent impact situation to the head of the user.

SUMMARY OF THE INVENTION

These and other objects of the present invention are achieved by a protective helmet assembly including an outer impact shell and an inner impact attenuation liner assembly wherein a chinstrap assembly is mounted to the inner impact attenuation liner assembly and the inner impact attenuation liner assembly is mounted within the outer impact shell to detach under predetermined load conditions from the outer impact shell.

BRIEF DESCRIPTION OF THE DRAWINGS

Further objects and advantages of the present invention will become apparent upon consideration of the detailed disclosure thereof, especially when taken with the accompanying drawings wherein like numerals designate like parts throughout and wherein;

FIG. 1 is a profile view, partially cut away, of the protective helmet assembly of the present invention;

FIG. 2 is a cross-sectional view of a protective helmet assembly of the present invention taken along the line II—II of FIG. 1.

DETAILED DESCRIPTION OF THE INVENTION

Figure 3:
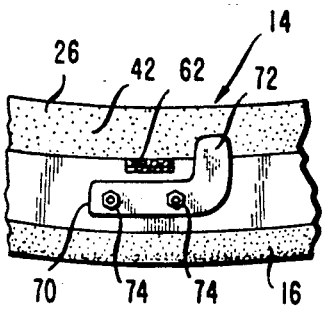
FIG. 3 is a partial plan view of the resilient mounting assembly of the inner liner assembly to the outer shell.

Referring now to the drawings, there is illustrated in FIG. 1 a profile view of a fireman's protective helmet assembly embodying the present invention, generally indicated as 10, comprised of an outer shell 12 in which is mounted an inner impact attenuation liner assembly, generally indicated as 14. The outer shell 12 is formed with a brim 16 wider at the back than at the front to shield the back of the wearer's neck. A transparent visor 18 is rotatably mounted by mounting assembly 20 to the outer shell 12 to be lowered to provide eye protection to the user. A chinstrap assembly, generally indicated as 22, including a chincup 24 is mounted in a load release mode to the inner liner 14 as more fully hereinafter described.

The inner impact attenuation liner assembly 14 is positioned within the outer shell 12, referring to FIG. 2, and is comprised of a hemi-ovoid-shaped non-resilient foam liner 26 and a cradle 28 of a plurality of web straps 30. The helmet assembly 10 is supported on the wearer's head by an adjustable headband 32 lined with a sweatband 34. The headband 32 is attached to the foam liner 26 by an adjustable system of holes 36 and snap buttons 38. The foam liner 26 of the inner liner assembly 14 is frictionally fitted within the outer shell 12. The exterior surface of the foam liner 26 corresponds to the interior surface of the helmet shell 10. Frictional retention of the foam liner 26 in the outer shell 12 is augmented by the use of cooperating patches of hook and loop fastener material, generally indicated as 40, such as that sold under the trademark "Velcro®", reference to FIG. 1.

The foam liner 26 is molded of a non-resilient foam material, such as polyurethane and is chosen to be deformable under high lateral impact conditions to distribute the force of impact over a relatively large area of the head and to absorb energy while deforming to reduce the lateral force transmitted to the head. The lower portion of the foam liner 26 is encased in a plastic annular rim 42 of channel cross-section. Each strap 30 is formed of a strong webbing, such as nylon, stitched together at the central apex of the cradle 28 and proceeds from the apex to the rim 42 of the foam liner 26 at a notch (not shown) formed in the rim 42. Each strap 30 wraps about the rim 42 and proceeds upwardly along the outer surface of the foam liner 26, is wrapped about a tube member 44 inset in a groove 46 formed in the outer surface of the foam liner 26, and then proceeds back around the lower rim 42 of the foam liner 26 to approach the apex as a free end with a loop 48. The loops 48 of the free ends of each of the straps 30 are collected by a drawstring 50 knotted to allow adjustment of the cradle 28 to suit the individual.

Figure 4:
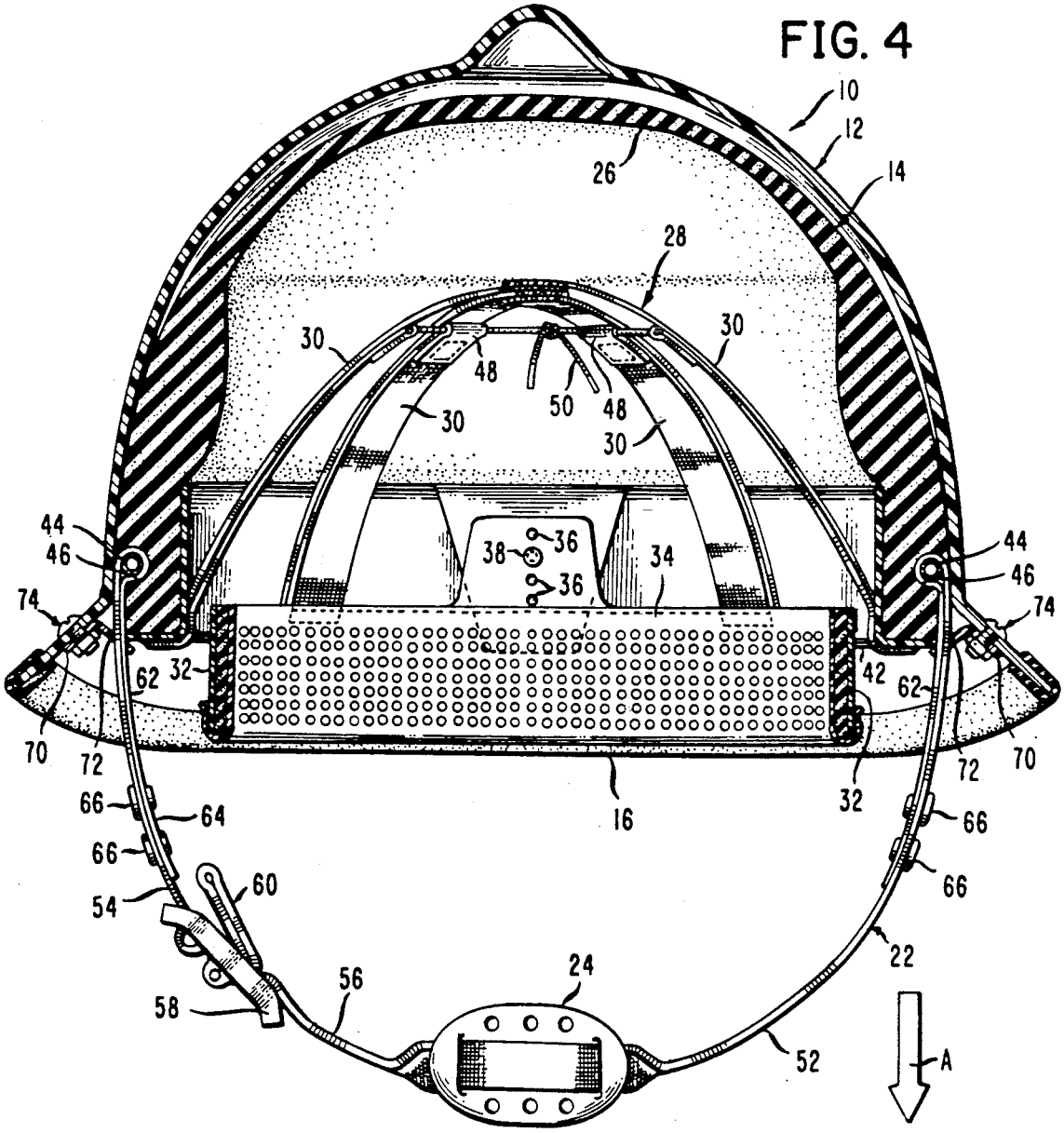
FIG. 4 is a cross-sectional view of the protective helmet assembly of the present invention illustrating release of the inner liner assembly from the outer shell.

The chinstrap assembly 22 is comprised of chinstrap members 52 and 54 formed of a strong webbing material, such as nylon, with an end 56 of one strap member 52 provided with an engaging clip member 58 for affixing the chinstrap member 54 into the cooperating chinstrap assembly 22 for encircling about the user's jaw with the chincup 24 closely engaging the user's chin. The chinstrap member 52 is formed with an extended free-end portion 60 to act as a barrier between the clip member 58 and the face of the user. Each chinstrap member 52 and 54 is mounted to the inner liner assembly 14, such as by the other ends 62 and 64 thereof, respectively encircling the tube member 44 and thence mounted to respective mid portions thereof, such as by cooperating lock member 66 referring particularly to FIGS. 2 and 4.

To the interior surface portion of the brim 16 of the outer shell 12 referring to FIG. 3, there are provided on either side thereof a retaining clip member 70 including an inwardly extending arm portion 72 mounted, such as by screw and bolt assemblies 74. The clip members 70 are mounted to the brim 16 of the outer shell 12 after positioning of the inner liner assembly 14 within the outer shell 12. Each clip member 70 is preferably mounted to the brim 16 of the outer shell 12 proximate each respective chinstrap member 52 and 54 with the arm or flange portion 72 engaging a lower surface portion of the annular rim member 42 of the inner liner assembly 14 to securely retain the inner liner assembly 14 within the outer shell 12.

The clip member 70 is preferably formed of a flexible material, generally a plastic material, such as an acetal resin, and is of a dimension, i.e. thickness, width and projection such that the arm or flange portion 72 bends or flex when the inner liner assembly 14 with respect to the outer shell 12 is subjected to a shearing force of at least about 80 ±5 pounds and is capable of returning to an original configuration after flexure. The clip members 70 may be formed of a deformable metal or of a plastic material capable of snapping or breaking when subjected to a predetermined load or shearing forces, although a flexible clip member 70 is preferred to facilitate re-assembly of the inner shell assembly 14 within the outer shell 12 without necessity of new hardward, i.e. clip members 70.

In operation, referring to FIG. 2, the protective helmet assembly 10 is illustrated in user configuration with the arm or flange portions 72 of the clip members 70 retaining the inner liner assembly 14 within the outer shell 12 together with assistance of the Velcro® hook and pile fastener assemblies 40 (FIG. 1). Upon loadings of the chinstrap assembly 22 at a predetermined force, as illustrated by the arrow "A" referring to FIG. 4, to the brim 16 of the outer shell 12, or should the outer shell 12 become lodged and the firefighter's head loads the inner liner assembly 14 such as by hanging from the chinstrap assembly 22, the arm or flange portion 72 of each retention clip member 70 flexes, and together with the Velcro® fastening assemblies 40, release the inner liner assembly 14 from the outer shell 12.

After separation of the inner liner assembly 14 from the outer shell 12 with the user's head (not shown) still inside the inner liner assembly 14, the protective capacity of the inner liner assembly 14 continues to provide the user with impact and penetration protection from residual impacts. The lower profile of the inner liner assembly 14 prevents any additional exposure of the user to neck injury or choking as a consequence. The inner impact liner assembly 14 readily separates from the outer shell 12 without loss of integrity of such inner impact liner assembly 14 thereby permitting re-use with the outer shell 12 unless damaged after separation by a residual impact.

The inner liner assembly 14 may be readily re-positioned within the outer shell 12 by removing the clip members 70 to permit re-insertion of the inner liner assembly 14 within the outer shell 12 thereafter the clip members 70 are re-mounted to the brim 16 of the shell 12 by the nut and bolt assemblies 74 in a manner whereby the arm or flange portions 72 thereof contact the liner surface of the rim member 42 of the inner liner assembly 14.

While the invention has been described in connection with an exemplary embodiment thereof, it will be understood that many modifications will be apparent to those of ordinary skill in the art; and that this application is intended to cover any adaptions of variations thereof. Therefore, it is manifestly intended that this invention be only limited by the claims and the equivalents thereof.

What is claimed:

1. A protective helmet assembly which comprises:

an outer shell defining an internal chamber;

an inner liner assembly including a strap means for engaging a user's head positioned within said internal chamber of said outer shell; and clip members mounted to said outer shell, each of said clip members including an arm portion contacting said inner liner assembly for positioning said inner liner assembly within said chamber of said outer shell, for maintaining said inner liner assembly within said internal chamber below a predetermined load exerted on said inner liner assembly via said strap means engaging said user's head with respect to said outer shell.

2. The protective helmet assembly as defined in claim 1 wherein each of said clip members is formed of a flexible plastic material temporarily deformable above said predetermined load.

3. The protective helmet assembly as defined in claim 2 wherein said clip members are mounted to a brim of said outer shell, said arm portion of each of said clip members extending inwardly to contact a lower surface portion of said liner assembly.

4. The protective helmet assembly as defined in claim 1 and further including cooperating hook and pile assemblies mounted to said outer shell and inner liner assembly.

5. The protective helmet assembly as defined in claim 1 wherein each clip member is positioned on said outer shell proximate respective strap members of said strap means.

6. The protective helmet assembly as defined in claim 5 wherein said strap members are mounted to a resilient means positioned about a foam liner of said inner liner assembly.

7. The protective helmet assembly as defined in claim 1 wherein said predetermined load is about 80 ±5 pounds.

* * * * *